US012324462B1

(12) United States Patent
Sun

(10) Patent No.: US 12,324,462 B1
(45) **Date of Patent: *Jun. 10, 2025**

(54) UNDERWEAR

(71) Applicant: Ling Sun, Hulin (CN)

(72) Inventor: Ling Sun, Hulin (CN)

( * ) Notice: Subject to any disclaimer, the term of this patent is extended or adjusted under 35 U.S.C. 154(b) by 0 days.

This patent is subject to a terminal disclaimer.

(21) Appl. No.: 18/960,036

(22) Filed: Nov. 26, 2024

Related U.S. Application Data

(63) Continuation-in-part of application No. 18/742,890, filed on Jun. 13, 2024.

(51) Int. Cl.
*A41C 3/00* (2006.01)

(52) U.S. Cl.
CPC ..... *A41C 3/0007* (2013.01)

(58) Field of Classification Search
CPC ..... A41C 3/12; A41C 3/0021; A41C 3/0007
USPC ..... 450/39
See application file for complete search history.

(56) References Cited

U.S. PATENT DOCUMENTS 2,759,190 A * 8/1956 Herbener ..... A41C 3/06 450/41
2,880,732 A * 4/1959 Smith ..... A41C 3/06 450/52
2,900,981 A * 8/1959 Herbener ..... A41C 3/06 450/48
2,965,103 A * 12/1960 Blair ..... A41C 3/0007 450/42
5,916,829 A * 6/1999 Girard ..... A41D 31/02 450/156
6,106,363 A * 8/2000 Werner ..... A41C 3/122 450/52
6,206,753 B1 * 3/2001 Werner ..... A41C 3/122 450/52
7,690,965 B2 * 4/2010 Falla ..... A41C 3/0014 450/39
2003/0092355 A1 * 5/2003 Rabinowicz ..... A41C 5/00 450/1
2010/0297912 A1 * 11/2010 Falla ..... A41B 17/00 450/39

* cited by examiner

*Primary Examiner* — Gloria M Hale

(57) ABSTRACT

An underwear includes an underwear main body. The underwear main body includes a front piece and a rear piece. The front piece is connected to the rear piece. The front piece is provided with a first cup body and a second cup body. The underwear main body further includes an elastic supporting piece. The front piece includes an inner piece and an outer piece. The inner piece is connected to the outer piece. The elastic supporting piece is disposed between the inner piece and the outer piece. The elastic supporting piece is connected to the inner piece or the outer piece, and a transverse tensile force of the elastic supporting piece is great than a longitudinal tensile force of the elastic supporting piece.

20 Claims, 7 Drawing Sheets

UNDERWEAR

CROSS-REFERENCE TO RELATED APPLICATIONS

This application is a Continuation-in-Part of the U.S. application Ser. No. 18/742,890, filed on Jun. 13, 2024 and issued as U.S. Pat. No. 12,213,539 on Feb. 4, 2025, which is incorporated herein by reference in its entirety.

TECHNICAL FIELD

The present disclosure relates to the field of underwear, in particular to an underwear.

BACKGROUND ART

Existing underwear on the market, especially seamless underwear, has poor support for women with large breasts, making it difficult to support users' breasts. When the users wear such seamless underwear, their breasts are prone to sag. Women usually have accessory breasts on their chest, and when wearing such seamless underwear, the accessory breasts cannot be retracted, resulting in poor posture and low comfort, greatly affecting the user experience. Therefore, there is an urgent need to provide an underwear with good support and high comfort on the market to improve the user experience.

SUMMARY

In order to overcome the shortcomings of the prior art, an underwear is provided by the present disclosure. The underwear includes: an underwear main body, wherein the underwear main body includes a front piece and a rear piece, the front piece is connected to the rear piece, the front piece is provided with a first cup body and a second cup body; the underwear main body further includes an elastic supporting piece, the front piece includes an inner piece and an outer piece, the inner piece is connected to the outer piece, the elastic supporting piece is disposed between the inner piece and the outer piece, the elastic supporting piece is connected to the inner piece or the outer piece, and a transverse tensile force of the elastic supporting piece is great than a longitudinal tensile force of the elastic supporting piece.

Further, the elastic supporting piece includes a first side supporting piece, a second side supporting piece and a bottom supporting piece, the first side supporting piece is connected to one end of the bottom supporting piece, the second side supporting piece is connected to the other end of the bottom supporting piece, the first side supporting piece is disposed between the first cup body and one side of the rear piece, the second side supporting piece is disposed between the second cup body and the other side of the rear side piece, and the bottom supporting piece is disposed a lower side of the first cup body and the second cup body.

Further, the elastic supporting piece includes an intermediate supporting piece, the intermediate supporting piece is arranged between the first cup body and the second body, and the intermediate supporting piece is connected to the middle portion of the bottom support piece.

Further, the first side supporting piece, the second side supporting piece, the bottom supporting piece, and the intermediate supporting piece are integrally formed.

Further, the underwear includes a third connecting member, and the elastic supporting piece is connected to the inner piece on the outer piece through the third connecting member.

Further, the third connecting member is a third adhesive film with adhesive properties.

Further, the third connecting member is a third adhesive hot-melt film with adhesive properties.

Further, the third adhesive film is provided with a plurality of first air holes.

Further, the elastic supporting piece is connected to the inner piece or the outer piece through the third connecting member, the third connecting member is a third connecting adhesive film with adhesive properties, the third adhesive film includes a first side adhesive film, a second side adhesive film, a bottom adhesive film, and an intermediate adhesive film, the first side supporting piece is connected to the outer piece or the inner piece through the first side adhesive film, the second side supporting piece is connected to the outer piece or the inner piece through the second side adhesive film, the bottom supporting piece is connected to the outer piece or the inner piece through the bottom adhesive film, and the intermediate supporting piece is connected to the outer piece or the inner piece through the intermediate adhesive film Further, the first side adhesive film is connected to one end of the bottom adhesive film, the second side adhesive film is connected to the other end of the bottom adhesive film, and the intermediate adhesive film is connected to a middle portion of the bottom adhesive film.

Further, the first side adhesive film, the second side adhesive film, the bottom adhesive film, and the intermediate adhesive film are integrally formed.

Further, the first supporting part is connected between the first cup body and one side of the rear piece, and the first supporting part is configured for squeezing and retracting an accessory breast towards the first cup body; the second supporting part is connected between the second cup body and the other side of the rear piece, and the second supporting part is configured for squeezing and retracting another accessory breast towards the second cup body.

Further, the first supporting part is flexible, and the second supporting part is flexible.

Further, the first supporting part is a flexible first supporting steel frame, and the first supporting steel frame is formed by connecting a plurality of steel rings to each other; the second supporting part is a flexible second supporting steel frame, and the second supporting steel frame is formed by connecting the plurality of steel rings to each other.

Further, the first supporting part and the second supporting part are elongated, the first supporting part extends between an upper side of the first cup body and a lower side of the first cup body, and the second supporting part extends between an upper side of the second cup body and a lower side of the second cup body.

Further, further including a first connecting member and a second connecting member, wherein the first supporting part is connected between the first cup body and one side of the rear piece through the first connecting member, and the second supporting part is connected between the second cup body and the other side of the rear piece through the second connecting member.

Further, the first connecting member is a first connecting adhesive film with adhesive properties, and the second connecting member is a second connecting adhesive film with adhesive properties.

Further, the first connecting member is a first connecting hot melt adhesive film with adhesive properties, and the second connecting member is a second connecting hot melt adhesive film with adhesive properties.

Further, the first connecting member and the second connecting member are in an elliptical shape.

Further, the underwear main body further includes a first shoulder strap and a second shoulder strap; one end of the first shoulder strap is connected to one side of the front piece, the other end of the first shoulder strap is connected to one side of the rear piece, one end of the second shoulder strap is connected to the other side of the front piece, and the other end of the second shoulder strap is connected to the other side of the rear piece; one end of the first shoulder strap is connected to one side of the front piece through a plurality of first stitching threads, and the plurality of first stitching threads are threaded from a first position of the first shoulder strap and the front piece to a second position to form a first stitching protrusion; one end of the second shoulder strap is connected to the other side of the front piece through second stitching threads, and a plurality of the second stitching threads are threaded from a third position of the second shoulder strap and the front piece to a fourth position to form a second stitching protrusion.

Beneficial effects of the present disclosure are as follows. The underwear is provided by the present disclosure, including the underwear main body, the first supporting part, and the second supporting part. The underwear main body includes the front piece and the rear piece. The front piece is connected to the rear piece. The front piece is equipped with the first cup body and the second cup body. The first supporting part is connected between the first cup body and one side of the rear piece, and the first supporting part is configured for squeezing and retracting an accessory breast towards the first cup body. The second supporting part is connected between the second cup body and the other side of the rear piece, and the second supporting part is configured for squeezing and retracting another accessory breast towards the second cup body. Therefore, when a user is wearing the underwear, the first supporting part can squeeze and retract the accessory breast towards the first cup body, and the second supporting part can squeeze and retract another accessory breast towards the second cup body, so that the accessory breasts on both sides of the user's chest can be retracted, making the user's chest more three-dimensional and full, effectively improving the user's posture when wearing the underwear, and improving the user's confidence. Moreover, the first supporting part and the second supporting part can effectively lift and pull the first cup body and the second cup body to improve a supporting capacity of the underwear, prevent the first cup body and the second cup body from sagging, and prevent the user's chest from sagging, thereby further improving the user's experience.

Further, the underwear main body further includes an elastic supporting piece. The front piece includes an inner piece and an outer piece. The inner piece is connected to the outer piece. The elastic supporting piece is arranged between the inner piece and the outer piece, and the elastic supporting piece is connected to the outer piece or the inner piece. A transverse tensile force of the elastic supporting piece is greater than its longitudinal tensile force. Through the above structure, due to the transverse tensile force of the elastic supporting piece being greater than its longitudinal tensile force, the transverse elasticity of the elastic supporting piece is larger. The elastic supporting piece can adapt to different chest sizes of users through transverse elastic deformation. Moreover, the longitudinal tensile force of the elastic supporting piece is smaller, making the longitudinal elastic deformation of the elastic supporting piece smaller, so as to improve a longitudinal lifting force of the underwear, improve the supporting force of the underwear, prevent the first cup body and the second cup body from sagging, and thus prevent the chest of the user from sagging. The elastic supporting piece is knitted by combining at least one strand of elastic yarn and at least one strand of non-elastic yarn. The elastic yarn is spandex yarn, and the non-elastic yarn is polyester yarn or cotton yarn. This elastic supporting piece not only incorporates elastic yarn during the knitting process, but also combines a unique yarn interweaving knitting structure, so that the elastic supporting piece has very good elasticity and the elasticity in all directions is ensured. Compared with an ordinary supporting piece, the transverse tensile force of the elastic supporting piece is much greater than its longitudinal tensile force, and the transverse elasticity is very large, which can adapt to different chest sizes of users. The longitudinal elasticity is very small, which can provide strong lifting force and supporting force, so that the supporting capacity of the underwear is improved to prevent the first cup body and the second cup body from sagging, thereby preventing the sagging of the user's chest.

BRIEF DESCRIPTION OF THE DRAWINGS

Implementations of the present disclosure will now be described, by way of embodiment, with reference to the attached figures. It should be understood, the drawings are shown for illustrative purpose only, for ordinary person skilled in the art, other drawings obtained from these drawings without paying creative labor by an ordinary person skilled in the art should be within scope of the present disclosure.

DETAILED DESCRIPTION OF THE EMBODIMENTS

Figure 1:
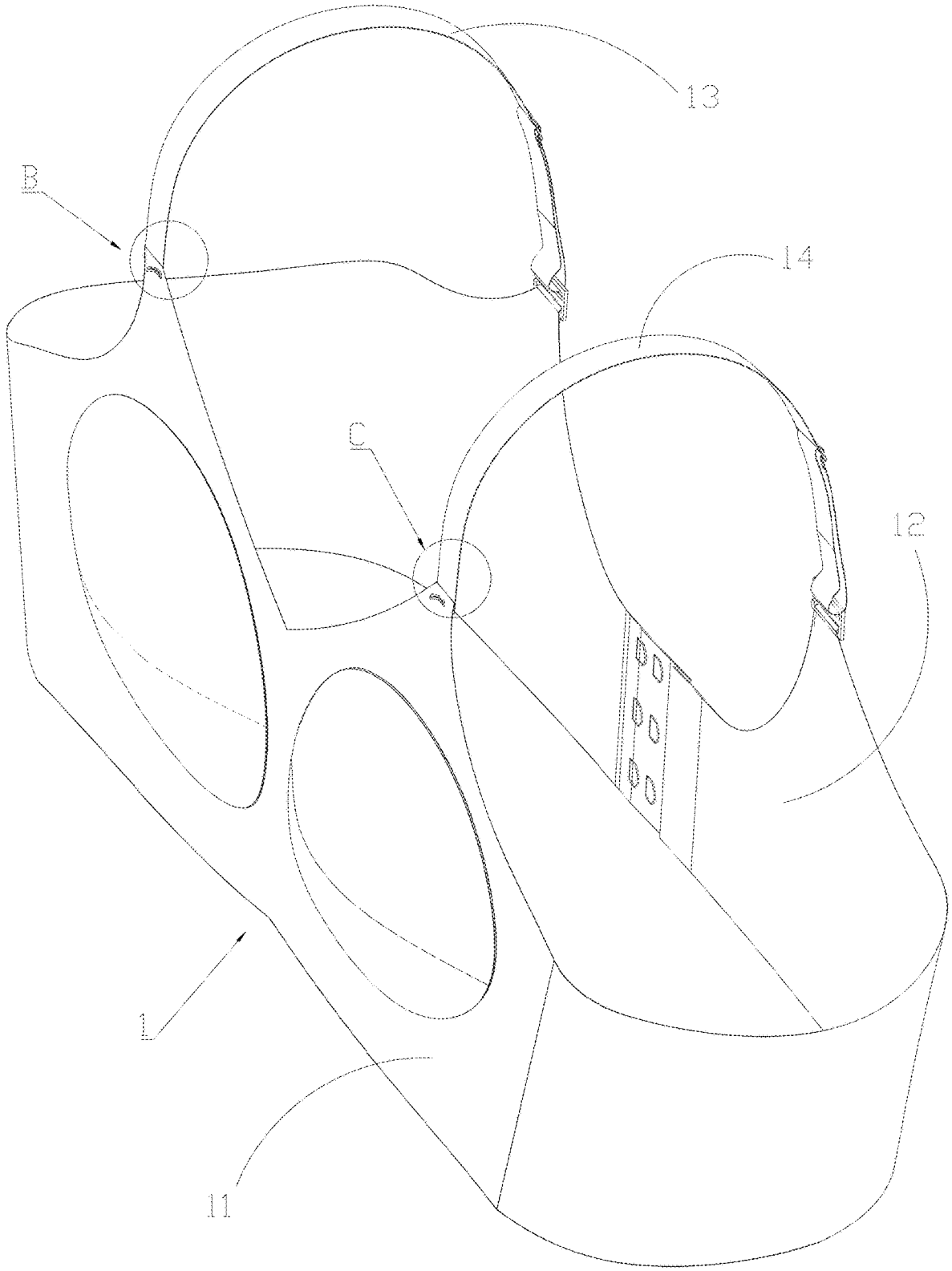
FIG. 1 is a schematic diagram of an overall structure of an underwear of the present disclosure.

It will be appreciated that for simplicity and clarity of illustration, where appropriate, reference numerals have been repeated among the different figures to indicate corresponding or analogous elements. In addition, numerous specific details are set forth in order to provide a thorough understanding of the exemplary embodiments described herein. However, it will be understood by those of ordinary skill in the art that the exemplary embodiments described herein may be practiced without these specific details. In other instances, methods, procedures, and components have not been described in detail so as not to obscure the related relevant feature being described. Also, the description is not to be considered as limiting the scope of the exemplary embodiments described herein. The drawings are not necessarily to scale and the proportions of certain parts may be exaggerated to better illustrate details and features of the present disclosure.

The term "comprising" when utilized, means "including, but not necessarily limited to"; it specifically indicates open-ended inclusion or membership in the so-described combination, group, series, and the like. The disclosure is illustrated by way of example and not by way of limitation in the figures of the accompanying drawings in which like references indicate similar elements. It should be noted that references to "an" or "one" embodiment in this disclosure are not necessarily to the same embodiment, and such references can mean "at least one". In addition, the terms "first" and "second" are used for descriptive purposes only and cannot be understood as indicating or implying relative importance or implying the number of indicated technical features. Thus, the features defined as "first" and "second" may explicitly or implicitly include one or more of the features. In the description of embodiments of the application, "a plurality of" means two or more, unless otherwise specifically defined.

Figure 2:
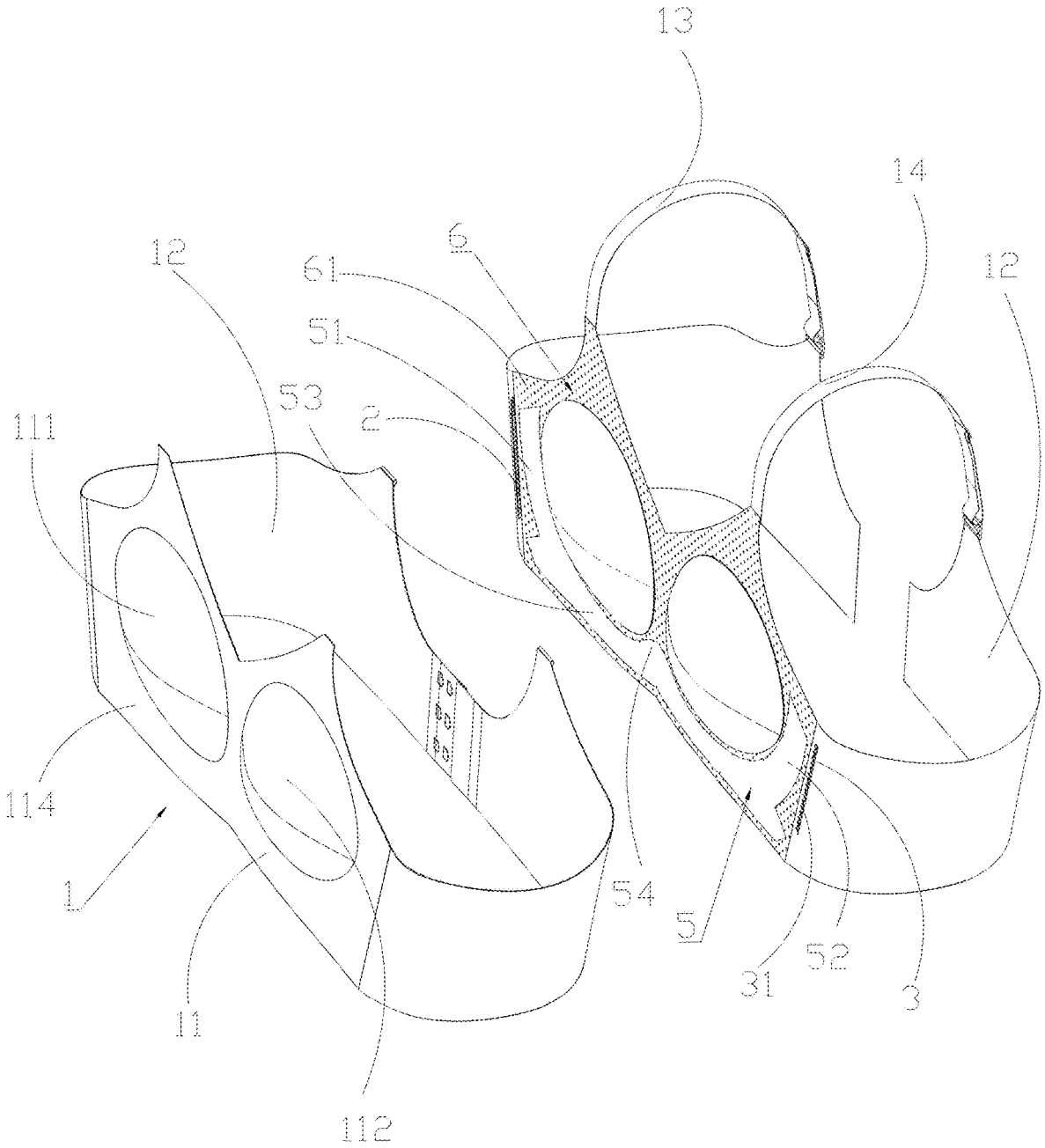
FIG. 2 is an exploded view of the underwear of the present disclosure.
Figure 3:
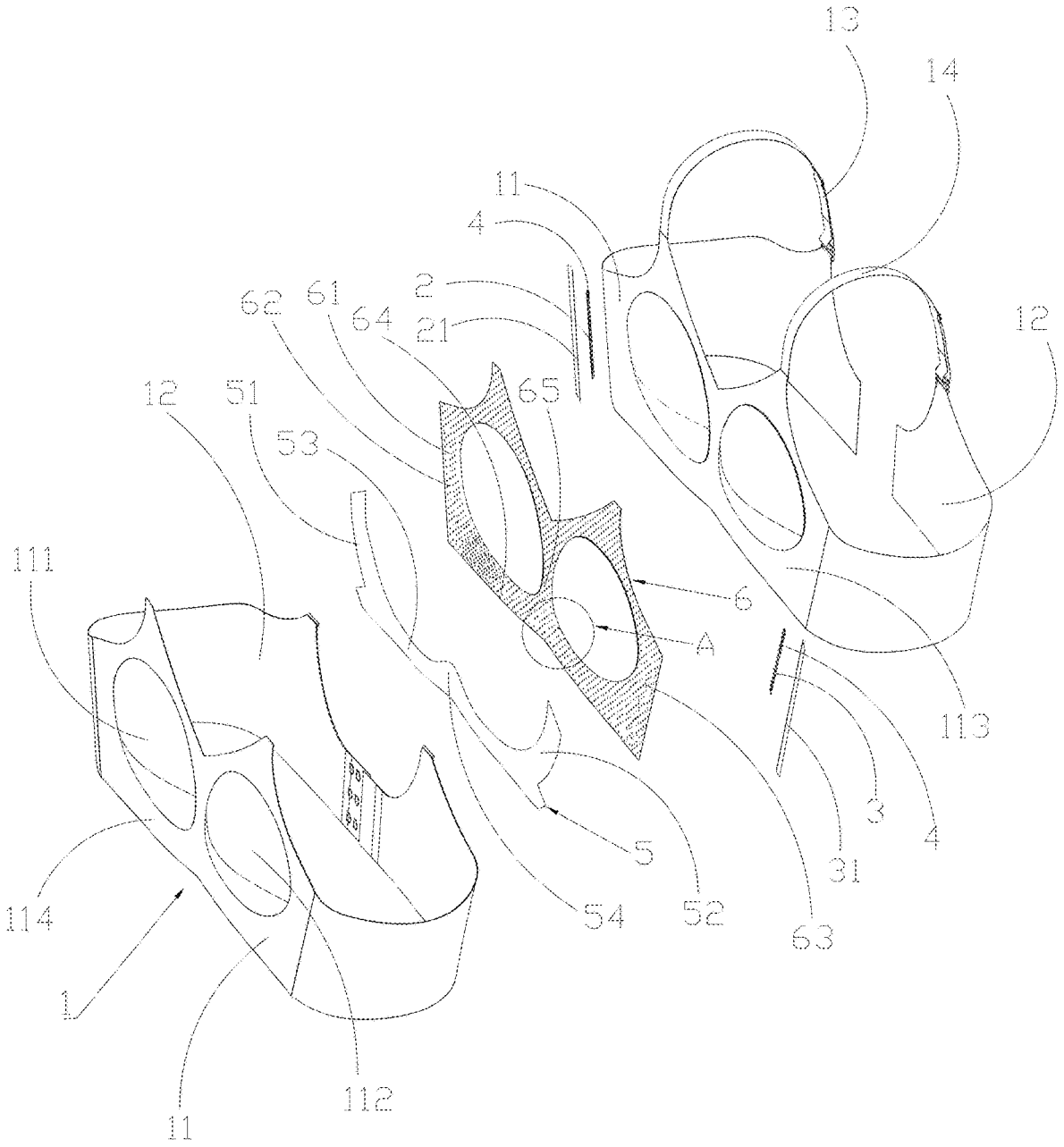
FIG. 3 is another exploded view of the underwear of the present disclosure.
Figure 4:
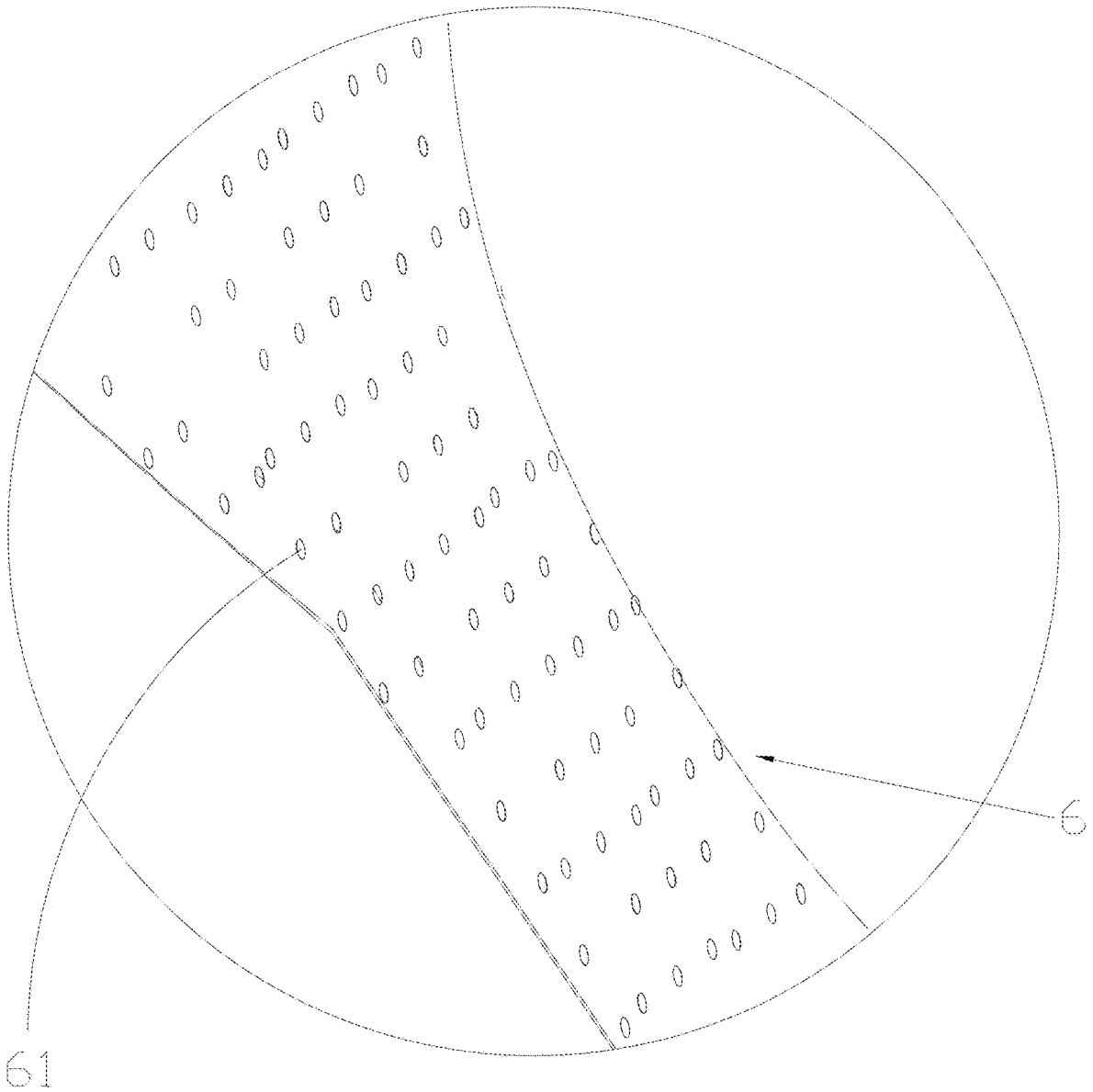
FIG. 4 is an enlarged view of area A in FIG. 3.
Figure 5:
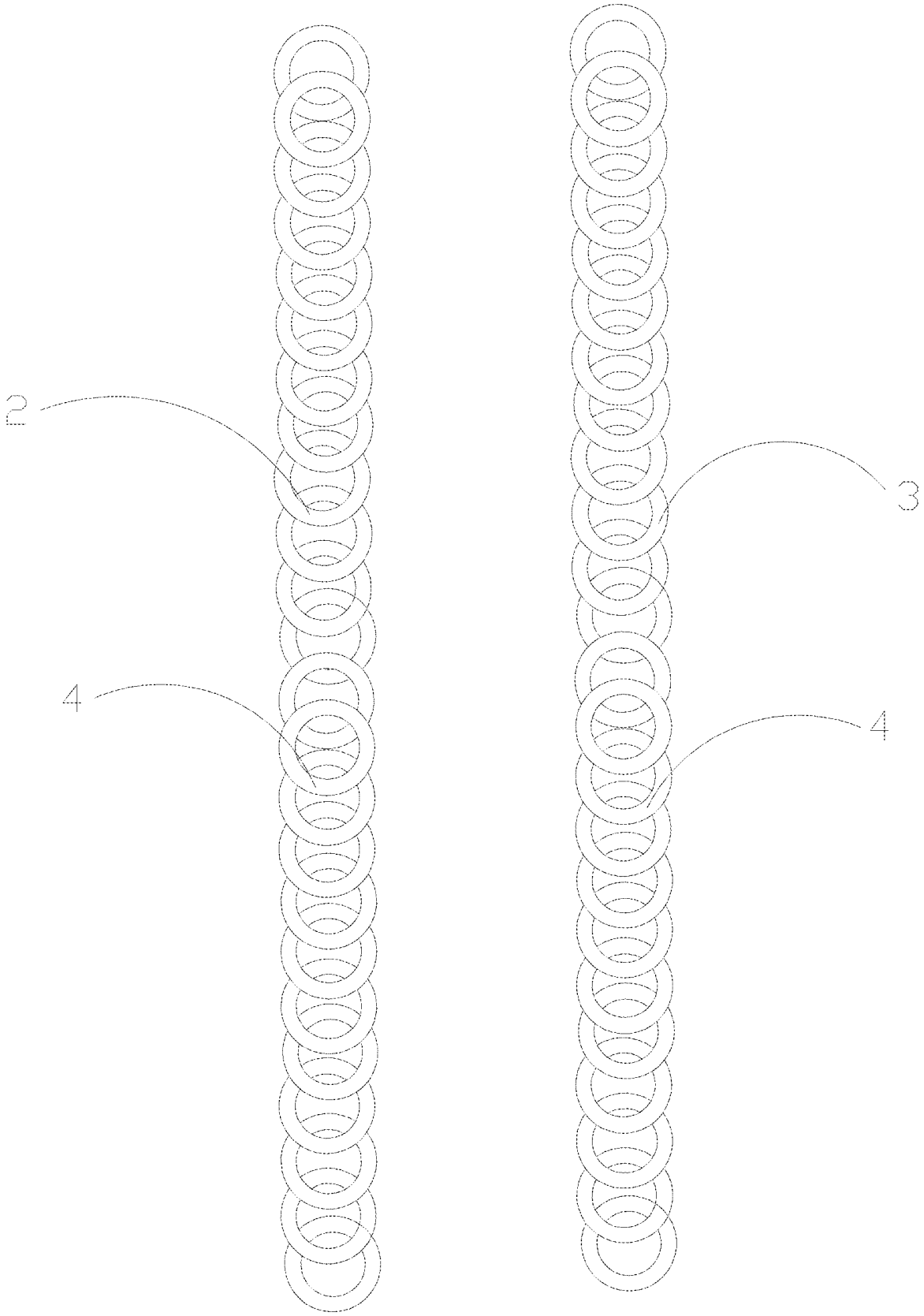
FIG. 5 is a structural schematic diagram of a first supporting part and a second supporting part of the underwear of the present disclosure.
Figure 6:
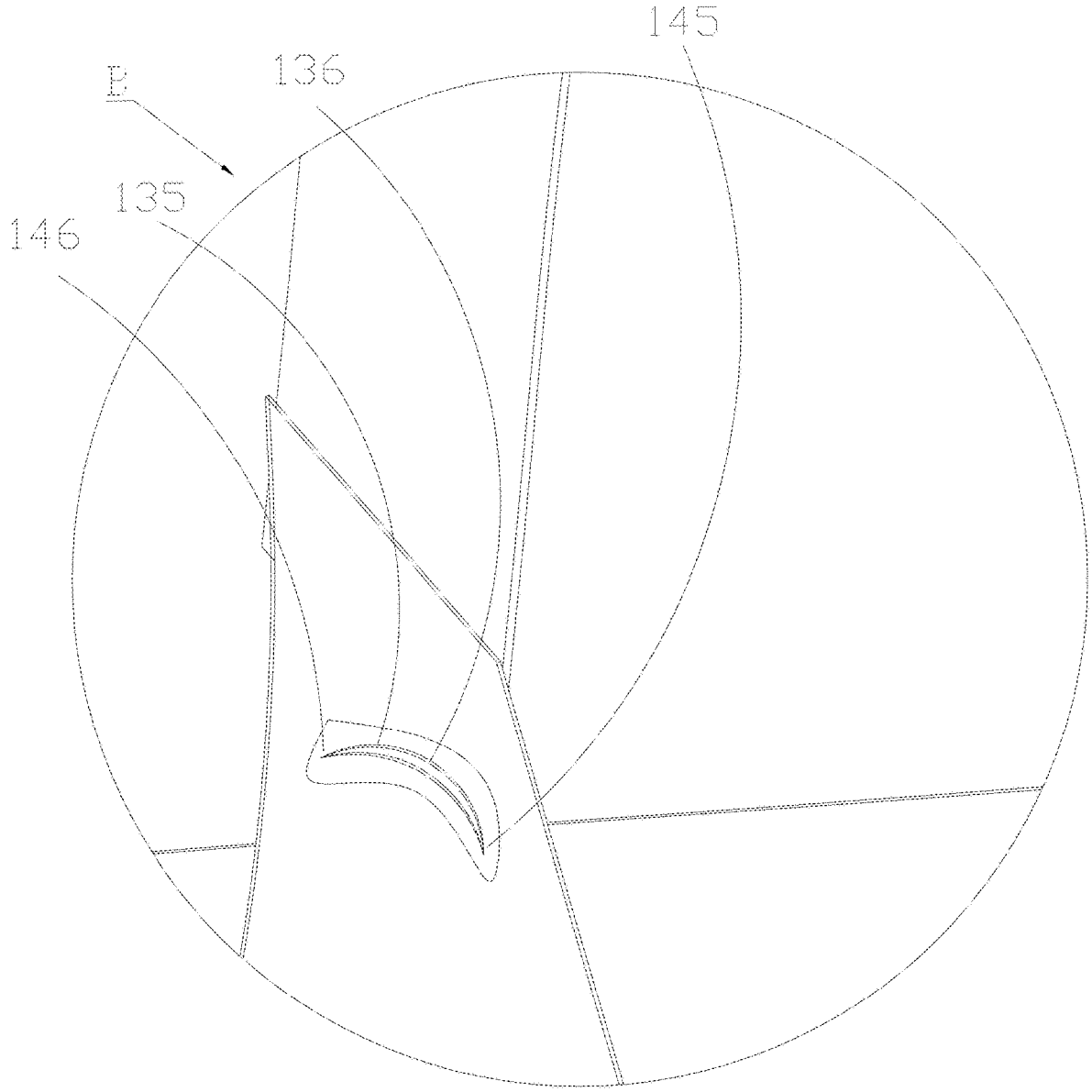
FIG. 6 is an enlarged view of area B in FIG. 1.
Figure 7:
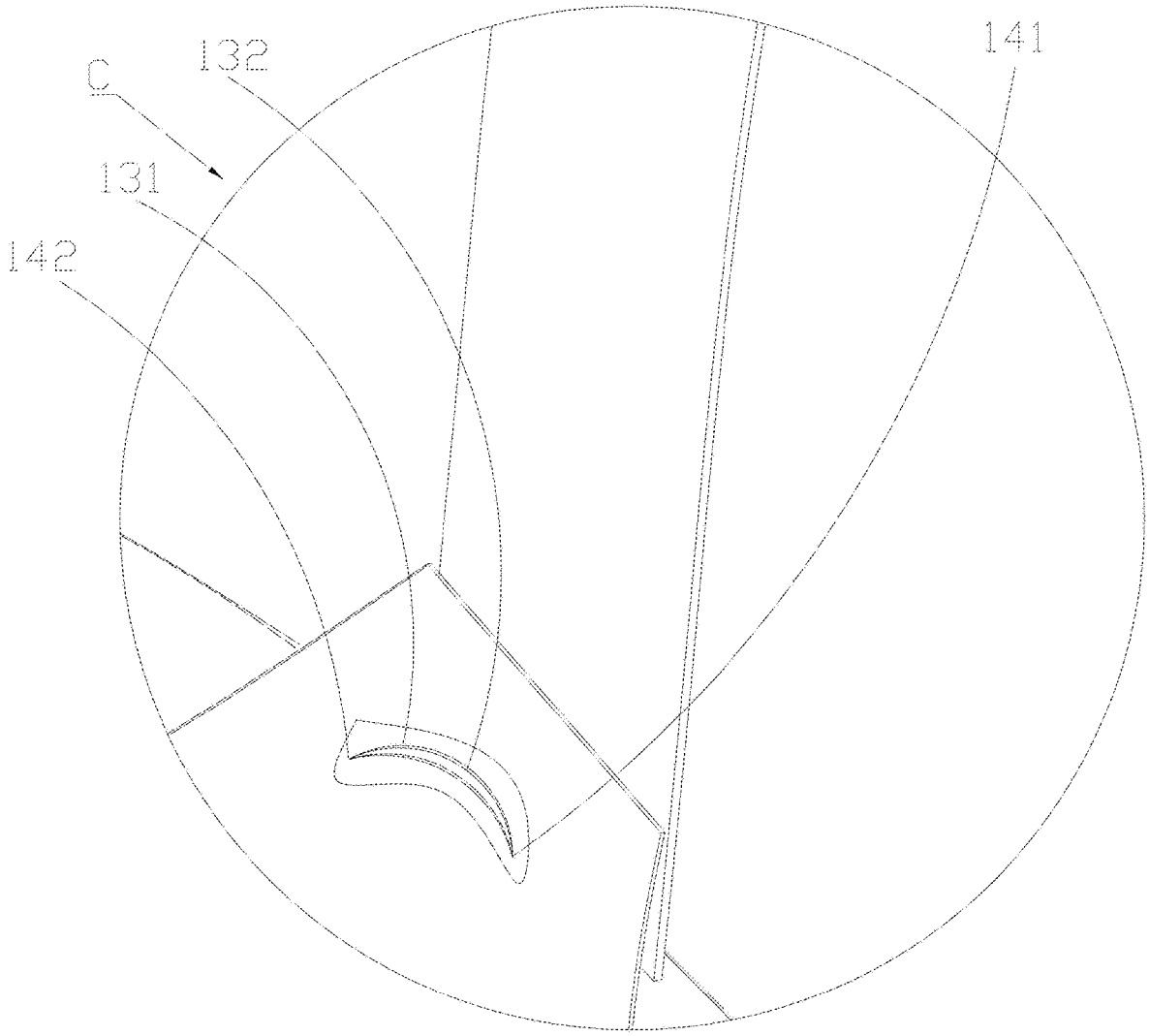
FIG. 7 is an enlarged view of area C in FIG. 1.

Referring to FIGS. 1-7, an underwear includes: an underwear main body 1, wherein the underwear main body 1 includes a front piece 11 and a rear piece 12, the front piece 11 is connected to the rear piece 12, and the front piece 11 is equipped with a first cup body 111 and a second cup body 112; a first supporting part 2, wherein the first supporting part 2 is connected between the first cup body 111 and one side of the rear piece 12, and the first supporting part 2 is configured for squeezing and retracting an accessory breast towards the first cup body 111; and a second supporting part 3, wherein the second supporting part 3 is connected between the second cup body 112 and the other side of the rear piece 12, and the second supporting part 3 is configured for squeezing and retracting another accessory breast towards the second cup body 112.

Through the above structure, the underwear includes the underwear main body 1, the first supporting part 2, and the second supporting part 3. The underwear main body 1 includes the front piece 11 and the rear piece 12. The front piece 11 is connected to the rear piece 12. The front piece 11 is equipped with the first cup body 111 and the second cup body 112. The first supporting part 2 is connected between the first cup body 111 and one side of the rear piece 12, and the first supporting part 2 is configured for squeezing and retracting an accessory breast towards the first cup body 111. The second supporting part 3 is connected between the second cup body 112 and the other side of the rear piece 12, and the second supporting part 3 is configured for squeezing and retracting another accessory breast towards the second cup body 112. Therefore, when a user is wearing the underwear, the first supporting part 2 can squeeze and retract the accessory breast towards the first cup body 111, and the second supporting part 3 can squeeze and retract another accessory breast towards the second cup body 112, so that the accessory breasts on both sides of the user's chest can be retracted, making the user's chest more three-dimensional and full, effectively improving the user's posture when wearing the underwear, and improving the user's confidence. Moreover, the first supporting part 2 and the second supporting part 3 can effectively lift and pull the first cup body 111 and the second cup body 112 to improve a supporting capacity of the underwear, prevent the first cup body 111 and the second cup body 112 from sagging, and prevent the user's breasts from sagging, thereby further improving the user's experience. The underwear main body 1 is a seamless underwear main body 1.

In this embodiment, the first supporting part 2 is flexible, and the second supporting part 3 is flexible. The first supporting part 2 is a flexible first supporting steel frame, and the first supporting steel frame is formed by connecting a plurality of steel rings 4 to each other. The second supporting part 3 is a flexible second supporting steel frame, and the second supporting steel frame is formed by connecting the plurality of steel rings 4 to each other. Specifically, both the first supporting part 2 and the second supporting part 3 are elongated. The first supporting part 2 extends between an upper side of the first cup body 111 and a lower side of the first cup body 111, and the second supporting part 3 extends between an upper side of the second cup body 112 and a lower side of the second cup body 112. Through the above structure, since the first supporting part 2 is the flexible first supporting steel frame formed by connecting the plurality of steel rings 4 to each other, and the second supporting part 3 is the flexible second supporting steel frame formed by connecting the plurality of steel rings 4 to each other, the first supporting steel frame and the second supporting steel frame can provide strong supporting force, squeezing the accessory breasts on both sides of the user's chest towards the first cup body 111 and the second cup body 112. Moreover, both the first supporting part 2 and the second supporting part 3 are elongated, the first supporting part 2 extends between the upper side of the first cup body 111 and the lower side of the first cup body 111, the second supporting part 3 extends between the upper side of the second cup body 112 and the lower side of the second cup body 112, the first supporting part 2 is the flexible first supporting steel frame formed by connecting the plurality of steel rings 4 to each other, and the second supporting part 3 is the flexible second supporting steel frame formed by connecting the plurality of steel rings 4 to each other, so that the transverse elasticity of the first supporting steel frame and the second supporting steel frame is small to provided strong transverse supporting force, and a longitudinal extended part has a certain elasticity to better fit the chest curve of the user.

In this embodiment, the underwear further includes a first connecting member 21 and a second connecting member 31. The first supporting part 2 is connected between the first cup body 111 and one side of the rear piece 12 through the first connecting member 21, and the second supporting part 3 is connected between the second cup body 112 and the other side of the rear piece 12 through the second connecting member 31. The first connecting member 21 is a first connecting adhesive film with adhesive properties, and the second connecting member 31 is a second connecting adhesive film with adhesive properties. Specifically, the first connecting member 21 is a first connecting hot melt adhesive film with adhesive properties, and the second connecting member 31 is a second connecting hot melt adhesive film with adhesive properties. Furthermore, both the first connecting member 21 and the second connecting member 31 are in an elliptical shape. Through the above structure, the design is reasonable, the structure is simple, and the connection is stable, effectively achieving the setting of the first supporting part 2 and the second supporting part 3. Compared with a method of stitching, the first connecting hot melt adhesive film and the second connecting hot melt adhesive film are used to bond the first supporting part 2 and the second supporting part 3 to the underwear main body 1, which can keep a surface of the underwear main body 1 flat, improve the comfort of the user's wearing, and make the underwear more beautiful.

In this embodiment, the underwear main body 1 further includes an elastic supporting piece 5. The front piece 11 includes an inner piece 113 and an outer piece 114. The inner piece 113 is connected to the outer piece 114. The elastic supporting piece 5 is arranged between the inner piece 113 and the outer piece 114, and the elastic supporting piece 5 is connected to the outer piece 114 or the inner piece 113. A transverse tensile force of the elastic supporting piece 5 is greater than its longitudinal tensile force. Through the above structure, due to the transverse tensile force of the elastic supporting piece 5 being greater than its longitudinal tensile force, the transverse elasticity of the elastic supporting piece 5 is larger. The elastic supporting piece 5 can adapt to different chest sizes of users through transverse elastic deformation. Moreover, the longitudinal tensile force of the elastic supporting piece 5 is smaller, making the longitudinal elastic deformation of the elastic supporting piece 5 smaller, so as to improve a longitudinal lifting force of the underwear, improve the supporting force of the underwear, prevent the first cup body 111 and the second cup body 112 from sagging, and thus prevent the chest of the user from sagging. The elastic supporting piece 5 is knitted by combining at least one strand of elastic yarn and at least one strand of non-elastic yarn. The elastic yarn is spandex yarn, and the non-elastic yarn is polyester yarn or cotton yarn. This elastic supporting piece 5 not only incorporates elastic yarn during the knitting process, but also combines a unique yarn interweaving knitting structure, so that the elastic supporting piece 5 has very good elasticity and the elasticity in all directions is ensured. Compared with an ordinary supporting piece, the transverse tensile force of the elastic supporting piece 5 is much greater than its longitudinal tensile force, and the transverse elasticity is very large, which can adapt to different chest sizes of users. The longitudinal elasticity is very small, which can provide strong lifting force and supporting force, so that the supporting capacity of the underwear is improved to prevent the first cup body 111 and the second cup body 112 from sagging, thereby preventing the sagging of the user's chest. Furthermore, the first connecting hot melt adhesive film and the second connecting hot melt adhesive film bond the first supporting part 2 and the second supporting part 3 to the outer piece 114 or the inner piece 113 of the underwear main body 1, and the first supporting part 2 and the second supporting part 3 are positioned between the outer piece 114 and the inner piece 113. Moreover, in some embodiments, the elastic supporting piece can be set to have no elasticity in a longitudinal direction, that is no longitudinal elasticity, and only have the transverse elasticity, so as to further improve the supporting capacity of the underwear main body.

In this embodiment, the elastic supporting piece 5 includes a first side supporting piece 51, a second side supporting piece 52, and a bottom supporting piece 53. The first side supporting piece 51 is connected to one end of the bottom supporting piece 53, and the second side supporting piece 52 is connected to the other end of the bottom supporting piece 53. The first side supporting piece 51 is positioned between the first cup body 111 and one side of the rear piece 12, the second side supporting piece 52 is positioned between the second cup body 112 and the other side of the rear piece 12, and the bottom supporting piece 53 is positioned on a lower side of the first cup body 111 and a lower side of the second cup body 112. The elastic supporting piece 5 further includes an intermediate supporting piece 54. The intermediate supporting piece 54 is arranged between the first cup body 111 and the second cup body 112, and the intermediate supporting piece 54 is connected to a middle portion of the bottom supporting piece 53. Through the above structure, the elastic supporting piece 5 includes the first side supporting piece 51, the second side supporting piece 52, the intermediate supporting piece 54, and the bottom supporting piece 53, so that bottom portions and side portions of the first cup body 111 and the second cup body 112 can be effectively supported, improving the supporting force of the underwear, preventing the first cup body 111 and the second cup body 112 from sagging, and thus preventing the user's chest from sagging. The first side supporting piece 51, the second side supporting piece 52, the bottom supporting piece 53, and the intermediate supporting piece 54 are integrally formed.

In this embodiment, the underwear further includes a third connecting member 6. The elastic supporting piece 5 is connected to the inner piece 113 or the outer piece 114 through the third connecting member 6. The third connecting member 6 is a third connecting adhesive film with adhesive properties. Specifically, the third connecting member 6 is a third connecting hot melt adhesive film with adhesive properties. Furthermore, the third connecting adhesive film is equipped with a plurality of first air holes 61. Through the above structure, the connection between the elastic supporting piece 5 and the inner piece 113 or the outer piece 114 has been effectively achieved. Compared to the method of stitching, the elastic supporting piece 5 is bonded to the inner piece 113 or the outer piece 114 through the third connecting hot melt adhesive film, which can keep the surface of the underwear main body 1 flat, improve the comfort of the user's wearing, and make the underwear more beautiful. Moreover, due to the setting of the plurality of first air holes 61 on the third connecting adhesive film, the breathability of the underwear main body 1 can be effectively improved, thereby enhancing the comfort of the user's wearing.

In this embodiment, the elastic supporting piece 5 is connected to the inner piece 113 or the outer piece 114 through the third connecting member 6. The third connecting member 6 is the third connecting adhesive film with adhesive properties. The third connecting adhesive film includes a first side adhesive film 62, a second side adhesive film 63, a bottom adhesive film 64, and an intermediate adhesive film 65. The first side supporting piece 51 is connected to the outer piece 114 or the inner piece 113 through the first side adhesive film 62. The second side supporting piece 52 is connected to the outer piece 114 or the inner piece 113 through the second side adhesive film 63. The bottom supporting piece 53 is connected to the outer piece 114 or the inner piece 113 through the bottom adhesive film 64. The intermediate supporting piece 54 is connected to the outer piece 114 or the inner piece 113 through the intermediate adhesive film 65. The first side adhesive film 62 is connected to one end of the bottom adhesive film 64, the second side adhesive film 63 is connected to the other end of the bottom adhesive film 64, and the intermediate adhesive film 65 is connected to a middle portion of the bottom adhesive film 64. Specifically, the first side adhesive film 62, the second side adhesive film 63, the bottom adhesive film 64, and the intermediate adhesive film 65 are integrally formed. Through the above structure, the first side supporting piece 51, the second side supporting piece 52, the bottom supporting piece 53, and the intermediate supporting piece 54 are effectively connected with the underwear main body 1. Moreover, the first side supporting piece 51, the second side supporting piece 52, the bottom supporting piece 53, and the intermediate supporting piece 54 are bonded to the inner piece 113 or the outer piece 114 of the underwear main body 1 through the first side adhesive film 62, the second side adhesive film 63, the bottom adhesive film 64, and the intermediate adhesive film 65, which can keep the surface of the underwear main body 1 flat, improve the comfort of the user's wearing, and make the underwear more beautiful.

In this embodiment, the underwear main body 1 further includes a first shoulder strap 13 and a second shoulder strap 14. One end of the first shoulder strap 13 is connected to one side of the front piece 11, the other end of the first shoulder strap 13 is connected to one side of the rear piece 12, one end of the second shoulder strap 14 is connected to the other side of the front piece 11, and the other end of the second shoulder strap 14 is connected to the other side of the rear piece 12. Through the above structure, the underwear can be worn on the user's shoulders through the shoulder straps, further improving the supporting capacity of the underwear and preventing the underwear from sagging, thereby further preventing chest sagging. One end of the first shoulder strap is connected to one side of the front piece through a plurality of first stitching threads 131, and the plurality of first stitching threads 131 are threaded from a first position 141 of the first shoulder strap and the front piece to a second position 142 to form a first stitching protrusion 132. One end of the second shoulder strap is connected to the other side of the front piece through second stitching threads 135, and a plurality of the second stitching threads 135 are threaded from a third position 145 of the second shoulder strap and the front piece to a fourth position 146 to form a second stitching protrusion 136. Through the above structure, the shoulder straps are connected to the front piece and the rear piece through a plurality of stitching threads, which can enhance the strength of the connection and reduce a total number of stitching protrusions, so as to reduce the pressure on the skin caused by the stitching protrusions and improve the comfort of the user's wearing.

In this embodiment, the first connecting member, the second connecting member, and the third connecting member can also be other connecting members such as hook and loop fasteners. In this embodiment, setting the first connecting member, the second connecting member, and the third connecting member as hot melt adhesive films has the best effect.

The above description only describes embodiments of the present disclosure, and is not intended to limit the present disclosure; various modifications and changes can be made to the present disclosure. Any modifications, equivalent substitutions, and improvements made within the spirit and scope of the present disclosure are intended to be included within the scope of the present disclosure.

What is claimed is:

1. An underwear, comprising:

an underwear main body, wherein the underwear main body comprises a front piece and a rear piece, the front piece is connected to the rear piece, the front piece is provided with a first cup body and a second cup body; the underwear main body further comprises an elastic supporting piece, the front piece comprises an inner piece and an outer piece, the inner piece is connected to the outer piece, the elastic supporting piece is disposed between the inner piece and the outer piece, the elastic supporting piece is connected to the inner piece or the outer piece, and a transverse tensile force of the elastic supporting piece is greater than a longitudinal tensile force of the elastic supporting piece.

2. The underwear according to claim 1, wherein the elastic supporting piece comprises a first side supporting piece, a second side supporting piece and a bottom supporting piece, the first side supporting piece is connected to a first end of the bottom supporting piece, the second side supporting piece is connected to a second end of the bottom supporting piece, the first side supporting piece is disposed between the first cup body and a first side of the rear piece, the second side supporting piece is disposed between the second cup body and a second side of the rear side piece, and the bottom supporting piece is disposed a lower side of the first cup body and the second cup body.

3. The underwear according to claim 2, wherein the elastic supporting piece comprises an intermediate supporting piece, the intermediate supporting piece is arranged between the first cup body and the second body, and the intermediate supporting piece is connected to a middle portion of the bottom support piece.

4. The underwear according to claim 3, wherein the first side supporting piece, the second side supporting piece, the bottom supporting piece, and the intermediate supporting piece are integrally formed.

5. The underwear according to claim 1, wherein the underwear comprises a third connecting member, and the elastic supporting piece is connected to the inner piece on the outer piece through the third connecting member.

6. The underwear according to claim 5, wherein the third connecting member is a third adhesive film with adhesive properties.

7. The underwear according to claim 6, wherein the third connecting member is a third adhesive hot-melt film with adhesive properties.

8. The underwear according to claim 6, wherein the third adhesive film is provided with a plurality of first air holes.

9. The underwear according to claim 2, wherein the elastic supporting piece is connected to the inner piece or the outer piece through the third connecting member, the third connecting member is a third connecting adhesive film with adhesive properties, the third adhesive film comprises a first side adhesive film, a second side adhesive film, a bottom adhesive film, and an intermediate adhesive film, the first side supporting piece is connected to the outer piece or the inner piece through the first side adhesive film, the second side supporting piece is connected to the outer piece or the inner piece through the second side adhesive film, the bottom supporting piece is connected to the outer piece or the inner piece through the bottom adhesive film, and the intermediate supporting piece is connected to the outer piece or the inner piece through the intermediate adhesive film.

10. The underwear according to claim 9, wherein the first side adhesive film is connected to a first end of the bottom adhesive film, the second side adhesive film is connected to a second end of the bottom adhesive film, and the intermediate adhesive film is connected to a middle portion of the bottom adhesive film.

11. The underwear according to claim 10, wherein the first side adhesive film, the second side adhesive film, the bottom adhesive film, and the intermediate adhesive film are integrally formed.

12. The underwear according to claim 1, wherein the first supporting part is connected between the first cup body and a first side of the rear piece, and the first supporting part is configured for squeezing and retracting an accessory breast towards the first cup body; the second supporting part is connected between the second cup body and a second side of the rear piece, and the second supporting part is configured for squeezing and retracting another accessory breast towards the second cup body.

13. The underwear according to claim 12, wherein the first supporting part is flexible, and the second supporting part is flexible.

14. The underwear according to claim 13, wherein the first supporting part is a flexible first supporting steel frame, and the first supporting steel frame is formed by connecting a plurality of steel rings to each other, the second supporting part is a flexible second supporting steel frame, and the second supporting steel frame is formed by connecting the plurality of steel rings to each other.

15. The underwear according to claim 12, wherein both the first supporting part and the second supporting part are elongated, the first supporting part extends between an upper side of the first cup body and a lower side of the first cup body, and the second supporting part extends between an upper side of the second cup body and a lower side of the second cup body.

16. The underwear according to claim 12, further comprising a first connecting member and a second connecting member, wherein the first supporting part is connected between the first cup body and a first side of the rear piece through the first connecting member, and the second supporting part is connected between the second cup body and a second side side of the rear piece through the second connecting member.

17. The underwear according to claim 16, wherein the first connecting member is a first connecting adhesive film with adhesive properties, and the second connecting member is a second connecting adhesive film with adhesive properties.

18. The underwear according to claim 17, wherein the first connecting member is a first connecting hot melt adhesive film with adhesive properties, and the second connecting member is a second connecting hot melt adhesive film with adhesive properties.

19. The underwear according to claim 16, wherein the first connecting member and the second connecting member are in an elliptical shape.

20. The underwear according to claim 10, wherein the underwear main body further comprises a first shoulder strap and a second shoulder strap; a first end of the first shoulder strap is connected to a first side of the front piece, a second end of the first shoulder strap is connected to one side of the rear piece, a first end of the second shoulder strap is connected to a second side of the front piece, and a second end of the second shoulder strap is connected to a second side of the rear piece; a first end of the first shoulder strap is connected to a first side of the front piece through a plurality of first stitching threads, and the plurality of first stitching threads are threaded from a first position of the first shoulder strap and the front piece to a second position to form a first stitching protrusion; a first end of the second shoulder strap is connected to a second side of the front piece through second stitching threads, and a plurality of the second stitching threads are threaded from a third position of the second shoulder strap and the front piece to a fourth position to form a second stitching protrusion.

* * * * *